US011174605B2

(12) United States Patent
Stover et al.

(10) Patent No.: US 11,174,605 B2
(45) Date of Patent: Nov. 16, 2021

(54) MEZZANINE GATE ASSEMBLY

(71) Applicant: DIVERSE HOLDINGS, LLC, Delaware, OH (US)

(72) Inventors: Carl L. Stover, Ostrander, OH (US); Craig T. Jones, Johnstown, OH (US)

( * ) Notice: Subject to any disclaimer, the term of this patent is extended or adjusted under 35 U.S.C. 154(b) by 0 days.

(21) Appl. No.: 16/589,003

(22) Filed: Sep. 30, 2019

(65) Prior Publication Data

US 2020/0208361 A1 Jul. 2, 2020

Related U.S. Application Data

(60) Provisional application No. 62/738,354, filed on Sep. 28, 2018.

(51) Int. Cl.

| | |
|---|---|
| ***E06B 7/00*** | (2006.01) |
| ***E01F 13/06*** | (2006.01) |
| ***E06B 11/02*** | (2006.01) |

(52) U.S. Cl.

CPC ..... *E01F 13/06* (2013.01); *E06B 11/022* (2013.01)

(58) Field of Classification Search

CPC ..... E01F 13/06; E06B 11/022; E06B 11/025; E06B 11/02

USPC ..... 49/49, 63, 67, 68, 142, 145, 226, 232, 49/233

See application file for complete search history.

(56) References Cited

U.S. PATENT DOCUMENTS

| | | | | |
|---|---|---|---|---|
| 677,294 A * | 6/1901 | Kannel | E06B 3/90 | 49/68 |
| 3,633,311 A * | 1/1972 | Ulmann | G07C 9/10 | 49/35 |
| 3,742,647 A * | 7/1973 | Tomita | E06B 11/085 | 49/35 |
| 4,472,908 A * | 9/1984 | Wanzl | E05F 15/614 | 49/141 |
| 5,845,692 A * | 12/1998 | Kellem | E05G 5/003 | 160/118 |
| 5,941,024 A * | 8/1999 | Journault | E02D 29/12 | 182/112 |
| 7,963,069 B2 * | 6/2011 | Ropelato | E05F 15/649 | 49/49 |

(Continued)

*Primary Examiner* — Jerry E Redman
(74) *Attorney, Agent, or Firm* — Bryce D. Miracle, Esq.

(57) ABSTRACT

A mezzanine gate assembly is adapted to provide ingress and egress to an elevated platform while safely preventing falls and injury to workers positioned thereon or even below the mezzanine platform. The mezzanine assembly generally includes a support assembly which has a first and second upright support members. Each of the first and second upright support members has a base portion fixedly attached to the elevated platform and an upper portion which is configured to function as a post adjacent to the respective terminating railing. The mezzanine gate assembly comprises an interior gate assembly and an exterior gate assembly. Generally, each of the interior and exterior gate assemblies are designed to move and pivot through a path of motion which provides a plurality of points of travel. The interior gate assembly is operably designed to engage with and deviate rearward while the load is delivered to the platform via forklift in order to provide a barrier between the respective railing and side of the load. The exterior gate assembly is operably designed to provide a barrier while the load of goods is manually removed from the pallet.

7 Claims, 8 Drawing Sheets

(56) References Cited

U.S. PATENT DOCUMENTS

| | | | | |
|---|---|---|---|---|
| 2008/0000156 | A1* | 1/2008 | Stoffels | E01F 13/06 49/49 |
| 2009/0217591 | A1* | 9/2009 | LaCook | E04G 5/144 49/50 |
| 2015/0308179 | A1* | 10/2015 | Mercier | E06B 11/085 49/30 |
| 2020/0208361 | A1* | 7/2020 | Stover | E05D 15/00 |
| 2020/0325755 | A1* | 10/2020 | Craig | E21B 41/00 |

* cited by examiner

MEZZANINE GATE ASSEMBLY

CROSS-REFERENCE TO RELATED APPLICATION

This application is based upon and claims the priority filing date of the previously filed, copending U.S. Provisional patent application entitled "MEZZANINE GATE ASSEMBLY" filed Sep. 28, 2018, Ser. No. 62/738,354, the entire disclosure of which is hereby incorporated herein by reference.

FIELD OF THE INVENTION

The present invention relates to the field of safety gates, particularly with regard to a mezzanine gate assembly for the safe enclosure and access to an elevated loading and unloading area.

BACKGROUND

Mezzanines or mezzanine floor systems are semi-permanent floor systems which are frequently used in industrial operations having high ceilings such as warehousing, distribution or manufacturing. Mezzanines are typically built between two permanent original stories, generally allowing unused space to be utilized within the vertical space. Railings and/or chains typically provide the safety on the periphery of these areas.

Mezzanines are often built without fall protection resulting in frequent accidents including serious injury and even death. Moreover, in order for forklift and other machinery to access and deliver and receive goods to and from an elevated mezzanine level, an opening must be present within existing railing and barrier systems. There have been many attempts to try and solve this problem without any reliable, cost effective solution. For example, employees have been required to connect themselves to the mezzanine structure by way of a cable or other connection means, such that if they did fall the cable would prevent them from falling over the side of the mezzanine onto the floor below. However, this standard protocol requires that the employee painstakingly follow through with connecting and disconnecting throughout each position on the mezzanine—inherently wasting time and resources.

For the foregoing reason, there is a need for a safety gate that will sufficiently provide fall protection for workers on a mezzanine structure which is cost efficient and is easy to operate.

SUMMARY

In accordance with the invention, a mezzanine gate assembly is provided which couples as a cost efficient and reliable gate for preventing falls and injury as well as a gate that can easily be adapted for use in conjunction with a forklift for delivery of goods to and from an elevated platform. This provides a safe, low-cost, and time saving approach for preventing falls while efficiently delivering goods to and from an elevated platform without hassle.

The invention generally comprises independently operated interior and exterior gate assemblies which act to provide a continuous barrier at the delivery opening and between existing railing throughout the delivery of goods to a platform by way of forklift. The mezzanine gate assembly is qualified to meet or exceed OSHA laws and regulations per the United States Department of Labor, thereby preventing falls and mitigating risk.

In a specific version of the application, the mezzanine gate assembly is positioned along an edge of an elevated platform having a railing, the gate assembly comprising: a first and second upright support assemblies, each having a base portion and an upper portion, the upright support assemblies are laterally disposed defining a delivery opening.

In a version, a moveable exterior gate assembly is operably positioned and supported within the delivery opening, the exterior gate assembly comprising: a pivoting exterior first side frame and a reciprocal exterior second side frame, each side frame moving between a downward, closed position to an elevated, open position, each side frame comprising: parallel lower and upper swing arms having a proximal end and a distal end, each proximal end pivotally attached to the first upright support assembly, a vertical member pivotally connecting between each of the distal ends of each swing arm, the vertical member remaining vertical throughout the path of motion between the downward, closed position to the elevated, open position.

Further, in certain versions, a moveable interior gate assembly is operably positioned and supported within the delivery opening, the interior gate assembly comprising: a pivoting interior first side frame and a reciprocal interior second side frame pivotally mounted to the respective upright support members, each side frame being pivotal between a plurality of points of travel throughout its motion comprising a forward, closed position, an angled aft position, an elevated, angled aft position, a forward elevated position, each interior side frame comprising: parallel lower and upper swing arms having a proximal end and a distal end, each proximal end pivotally attached to the respective upright support assembly, each of the swing arms operably providing support for a plurality of rollers; and a pivotal vertical member pivotally connecting between each of the distal ends of each swing arm, the vertical member remains substantially vertical throughout the path of motion, the vertical member operably providing support for a plurality of rollers.

In certain versions of the application, a plurality of motors is provided which operate to move the exterior gate assembly and the interior gate assembly through their respective paths of motion; and a controller is provided for operating the plurality of motors to produce a sequence of operable motion pertaining to each of the exterior gate assembly and the interior gate assembly through their respective paths of motion.

In a version, a mezzanine gate assembly is positioned along an edge of an elevated platform having a railing, the gate assembly generally comprising a first and second upright support assemblies, each having a base portion and an upper portion, the upright support assemblies are laterally disposed defining a delivery opening therebetween; an exterior gate assembly operably positioned and supported within the delivery opening, the exterior gate assembly comprising: an exterior first side frame and a reciprocal exterior second side frame, each side frame independently movable between a downward, closed position to an elevated, open position; and an interior gate assembly operably positioned and supported within the delivery opening, the interior gate assembly comprising: an interior first side frame and a reciprocal interior second side frame pivotally mounted to the respective upright support members, each side frame vertically movable between a downward position to an elevated position and movable about a vertical axis from a forward position to an aft position allowing travel between an a forward, closed position to an aft, open position.

Still, other versions, benefits and advantages of the invention will become apparent to those skilled in the art to which it pertains upon a reading and understanding of the following detailed specification.

BRIEF DESCRIPTION OF THE DRAWINGS

These and other features, aspects, and advantages of the present invention will become better understood with regard to the following description and accompanying figures where.

DETAILED DESCRIPTION

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other versions that depart from these specific details. In other instances, detailed descriptions of well-known devices, circuits, and methods are omitted so as not to obscure the description of the present invention with unnecessary detail.

Moreover, the description is not to be taken in the limiting sense but is made merely for the purpose illustrating the general principles of the invention, since the scope of the invention is best defined by the appended claims. Various inventive features are described below that can each be used independently of one another or in combination with other features.

Unless otherwise defined, all technical terms used herein have the same meaning as commonly understood by one of ordinary skill in the art to which the invention belongs. As used in the specification and the appended claims, the singular forms "a," "an," and "the" include plural references unless the context clearly dictates otherwise. Any reference to "or" herein is intended to encompass "and/or" unless otherwise stated.

Referring now to the figures wherein the showings are for purposes of illustrating a preferred version of the invention only and not for purposes of limiting the same, the present invention is a mezzanine gate assembly 10 adapted to provide ingress and egress to an elevated platform 202 while safely preventing falls and injury to workers positioned thereon or even below the mezzanine platform 202. Generally, the gate assembly 10 is designed to meet or exceed industry standards in its current form.

Figure 9:
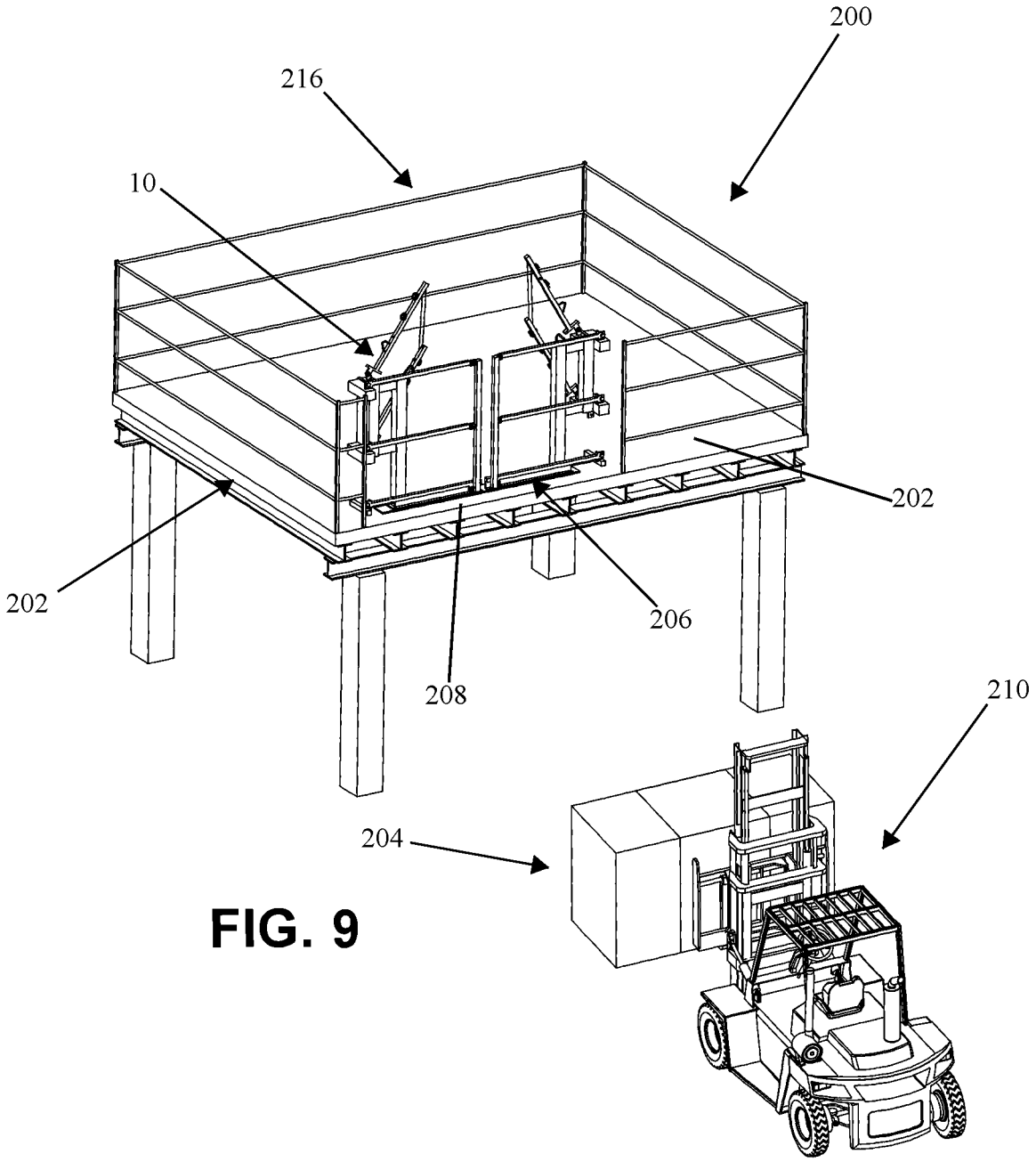
FIG. 9 is a perspective view of the mezzanine gate assembly as positioned on a mezzanine.

With reference to the figures, generally, a description of a version of the invention will be provided and is generally designated as numeral 10. With reference to the FIG. 9, a mezzanine structure 200 having an elevated platform 202 for delivering a load of goods 204 by way of a delivery opening 206 at the edge 208 is shown Typically, a forklift 210 is utilized to move the load of goods 204 via forks 212 and pallet 214 to the elevated platform 202 through the delivery opening 206. Typically, as illustrated, a railing 216 or chain is used to line the periphery of the mezzanine 200 in order to prevent falls. The delivery opening 206 is formed within a discontinuous portion of the railing 216 and mezzanine 200 structure.

As best illustrated by FIG. 1-FIG. 9, a version of the mezzanine gate assembly 10 is ideally positioned along the edge 208 of the elevated platform 202 at the delivery opening 206 for providing continuity with the perimeter railing 216 in order to prevent falls. In a version, the gate assembly 10 generally comprises an exterior gate assembly 12, an interior gate assembly 14, a support assembly 16 for supporting the interior and exterior gate assemblies 12, 14 throughout operation.

Figure 5:
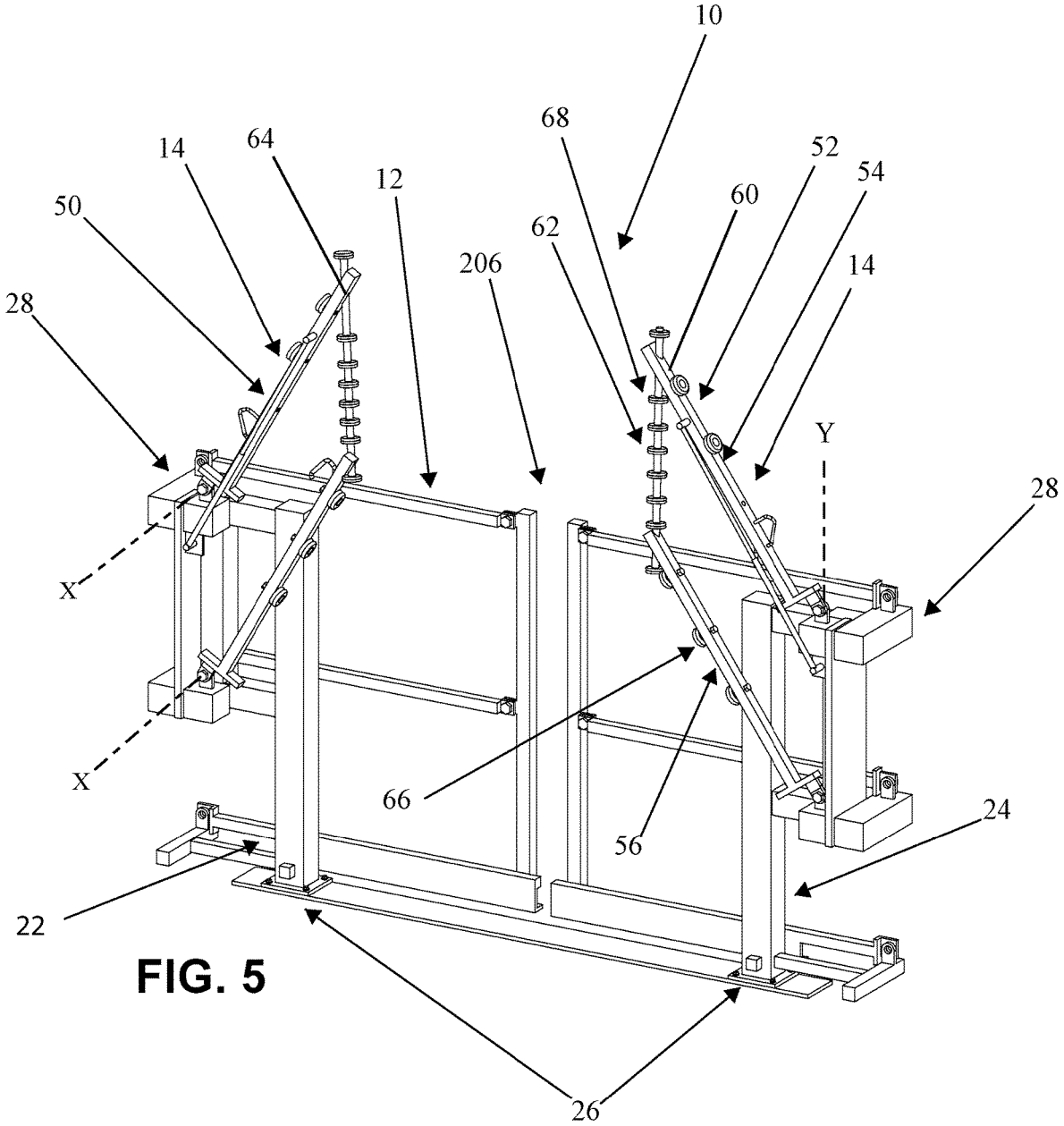
FIG. 5 is a rear perspective view showing the interior gate assembly while in the forward, raised position and the exterior gate assembly in the closed, default position of the version shown in FIG. 1.

In the illustrated version as best shown in FIG. 5, the support assembly 16 includes a first and second upright support members 22, 24. Each of the first and second upright support members 22, 24 having a base portion 26 fixedly attached to the elevated platform 202 and an upper portion 28 which is configured to function as a post adjacent to the respective terminating railing 216. The upright support members 22, 24 are laterally disposed further defining the delivery opening 206 therebetween and provide rigid stability for the moving components of the gate assembly 10 further described in detail below.

As best illustrated by FIG. 1-FIG. 5, the gate assembly 10 comprises an interior gate assembly 12 and an exterior gate assembly 14. Generally, each of the exterior and interior gate assemblies 12, 14 are designed to move and pivot through a path of motion which provides a plurality of points of travel which will be described in detail below regarding operation. The interior gate assembly 14 is operably designed to engage and deviate rearward while the load 204 is delivered to the platform 202 via forklift 210 in order to provide a barrier between the respective railing 216 and lateral side of the load 204 (FIG. 9-FIG. 16). The exterior gate 12 assembly is operably designed to provide a barrier while the load 204 is manually removed from the pallet 214.

Figure 2:
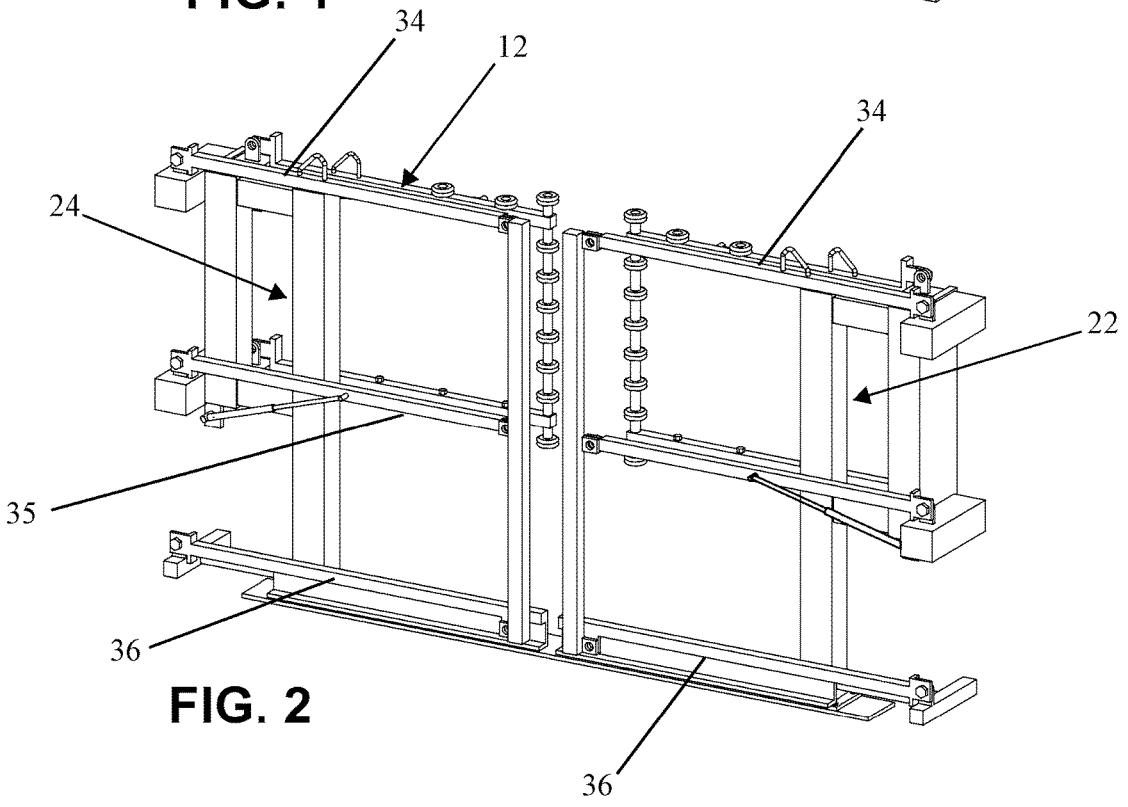
FIG. 2 is a front perspective view shown while in the default, closed position of the version shown in FIG. 1.
Figure 4:
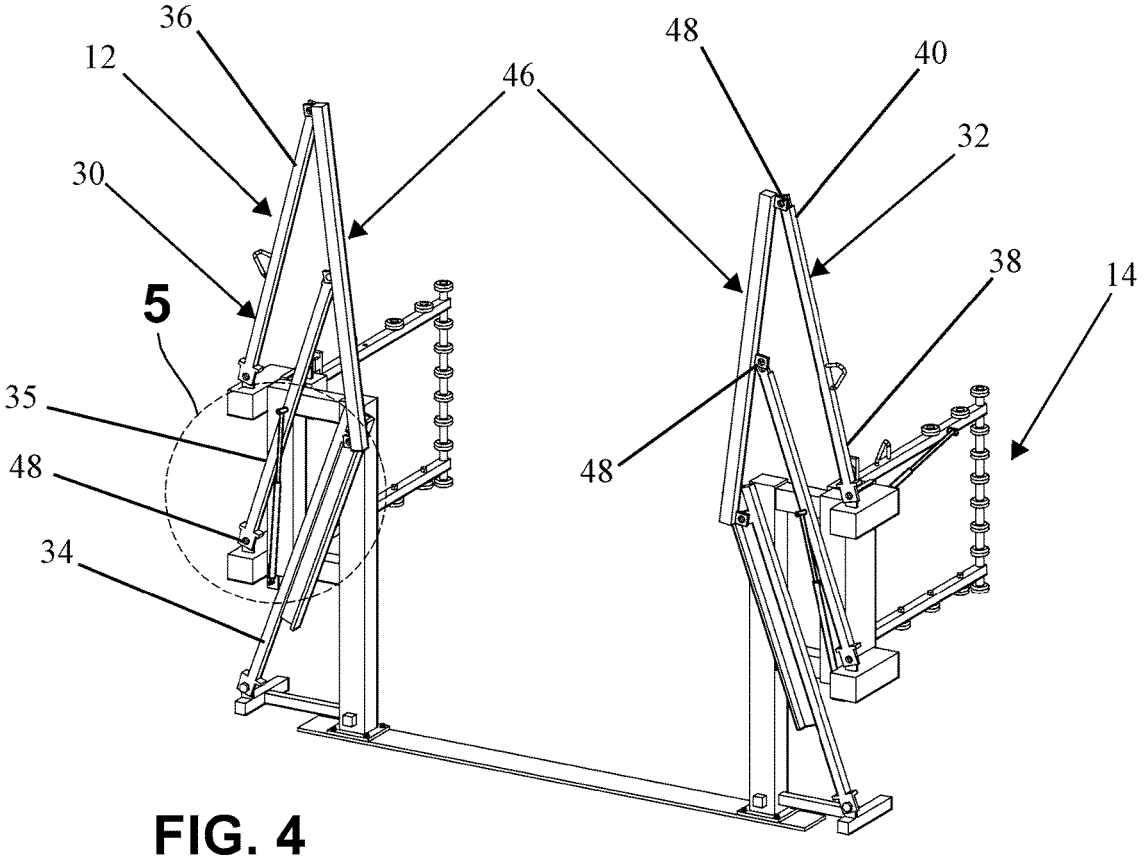
FIG. 4 is a front perspective view of the interior gate assembly of the version shown in FIG. 1 shown while in the interior gate assembly and the exterior gate assembly open position.

In further detail and referring to FIG. 2 and FIG. 4, a version of the exterior gate 12 generally comprises mirrored pivoting frames which move from a downward, closed position (See FIG. 2) to an elevated, open position (See FIG. 4), wherein the delivery opening 206 and interior gate 14 are exposed (See FIG. 4). In the version, the exterior gate 12 pivoting frames include an exterior first side frame 30 and an exterior second side frame 32. The first and second exterior side frames 30, 32 each boast parallel lower and upper swing arms 34, 36, each having a proximal end 38 and a distal end 42. The proximal ends 38 of each of the lower and upper swing arms 34, 36 are operably and pivotally attached to the requisite side upright support assembly 22, 24. The upper swing arm 36 proximal end 38 is connected towards the upper portion 28 of the requisite upright support assembly 22, 24 and the lower swing arm 34 proximal end 40 is connected midway between the base portion 26 and the upper portion 28 of the requisite upright support assembly 22, 24. In the illustrated version, the first and second exterior side frames 30, 32 further include an intermediary swing arm 35 in order to provide more support.

As best illustrated in FIG. 4, a vertical member 46 pivotally connects the distal ends 42, 44 of each requisite side of swing arms 34, 36 via hinged contacts 48. Generally, throughout operation of the exterior gate assembly 12, the vertical member 46 via hinged contacts 48 remains substantially vertical throughout the path of motion between the downward, closed position (FIG. 2) to the elevated, open position (FIG. 4) and provides structural supports between the upper, intermediary and lower swing arms 34, 35, and 36 throughout the path of motion between the downward, closed position and the elevated, open position.

Figure 1:
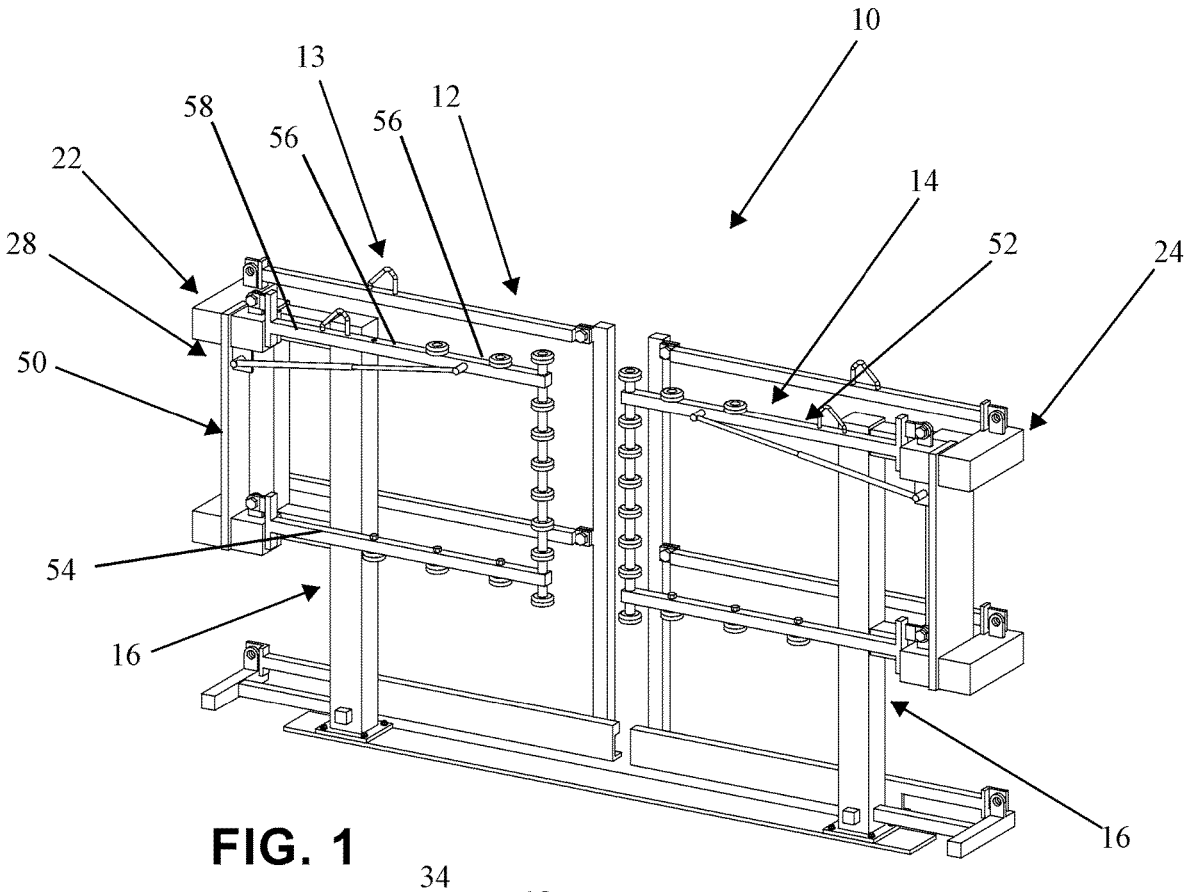
FIG. 1 is a rear perspective view showing a version of the mezzanine gate assembly shown while in a default, closed position.
Figure 3:
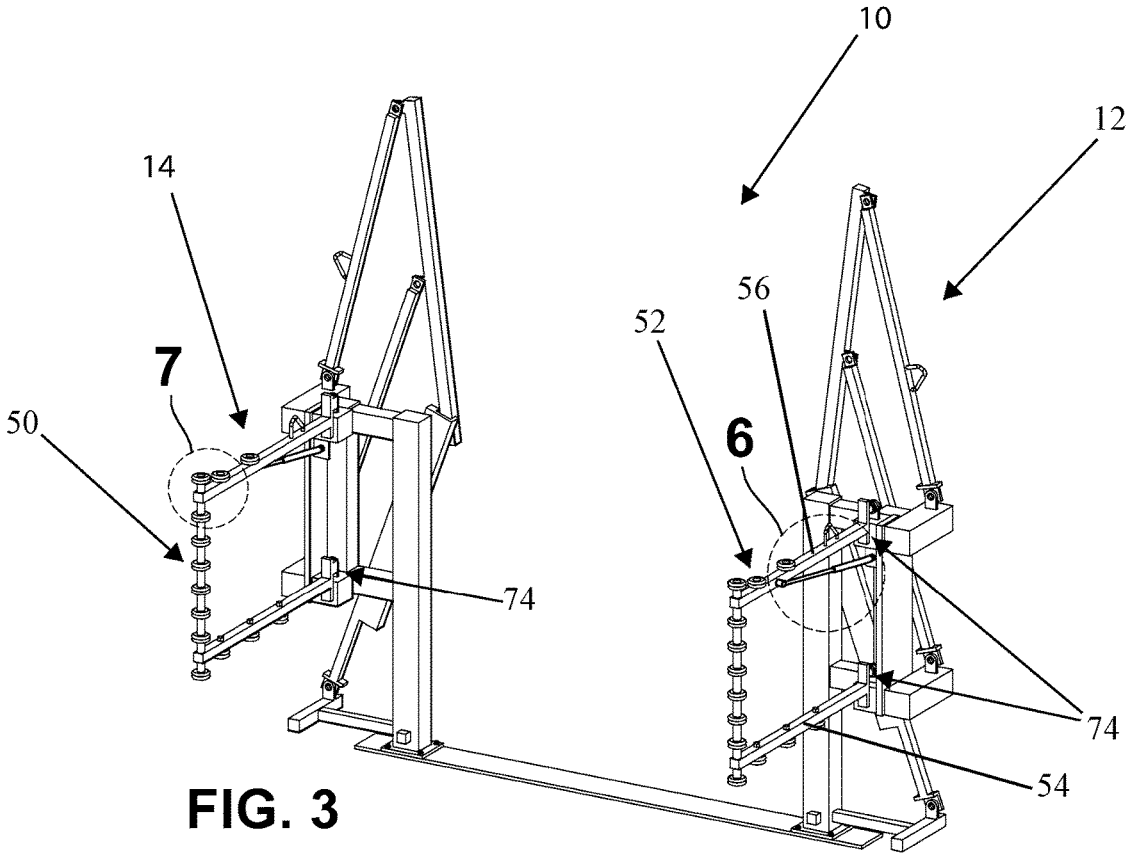
FIG. 3 is a rear perspective view of the interior gate assembly of the version shown in FIG. 1 shown while in the interior gate assembly and the exterior gate assembly open position.

As best illustrated by FIG. 1, FIG. 3, and FIG. 5, the interior gate assembly 14 is operably positioned and supported between the upright support assemblies 16 and aft or interior of the exterior gate assembly 12. The interior gate 14 assembly travels in a path of motion that is independent of the exterior gate 12 assembly.

As best illustrated by FIG. 1 and FIG. 3, the interior gate assembly 14 comprises an interior first side frame 50 and an interior second side frame 52 which are pivotally and operably mounted to the respective upright support assemblies 22, 24. Generally, each of the interior side frames 50, 52 are pivotal between a plurality of points of travel throughout its motion provided by a combination of horizontal and vertical axis X, Y of rotation (See FIG. 5) which comprises a forward, gate closed (default position, FIG. 2), an angled aft position (FIG. 3), an elevated aft position, and a forward elevated position (FIG. 4).

In further detail, the interior gate assembly is operably configured to pivot between a downward position (FIG. 1) to an elevated position via plurality of horizontal axis of rotation X allowing each interior first side frame 50 and the interior second side frame 52 to independently translate upward providing space therebetween (FIG. 5). Moreover, each of the first and second side frames are operably configured to rotate from a forward position to an aft position about a secondary axis Y. The combination of rotational axis X, Y allows each of the interior side frames 50, 52 to move between the forward, closed position (FIG. 1) to the aft, open position (FIG. 3) in a non-linear manner, for example the path of movement may follow and arc in order to lift over or avoid a pallet of goods.

Further, as illustrated, each of the first and second interior side frames 50, 52 of the interior gate assembly 14 generally comprises parallel lower and upper swing arms 54, 56, each having a proximal end 58 and a distal end 60. The proximal ends 58 of each swing arm 54, 56 is operably and pivotally attached to the requisite side upright support assembly 22, 24. The upper swing arm 56 proximal end 58 being connected towards the upper portion 28 of the support assembly 24 and the lower swing arm 54 proximal end 58 being connected midway between the base portion 26 and the upper portion 28 of the requisite upright support assembly 22, 24.

As best illustrated in FIG. 5, a vertical member 62 pivotally connects the distal ends 60 of each requisite lower and upper swing arms 54, 56. The vertical member 62, via hinged contacts 64 with each distal end 60, remaining substantially vertical throughout the path of motion and provides structural supports between the upper and lower swing arms 54, 56 throughout the path of motion (See FIG. 5).

In certain versions, each of the interior gate assembly 14 swing arms 54, 56 provide support for a plurality of multidirectional rollers 66 which operably provide rotation in multiple directions. As best illustrated in FIG. 42, the plurality of multidirectional rollers 66 and the rollers 68 help assist with receiving the vertical and horizontal movement of the load 204 onto the elevated platform 202. Therefore, allowing the load 204 to roll smoothly through the interior gate assembly 12, mitigating damage thereto.

In certain versions, the interior gate assembly 12 may be spring loaded in that it provides springs or other counterforce to bias movement back towards the downward, closed and default position throughout operation.

In certain versions, each of the interior and exterior gate assembly 14, 12 may further include handles 13 for assisting in movement of each respective gate.

Figure 6:
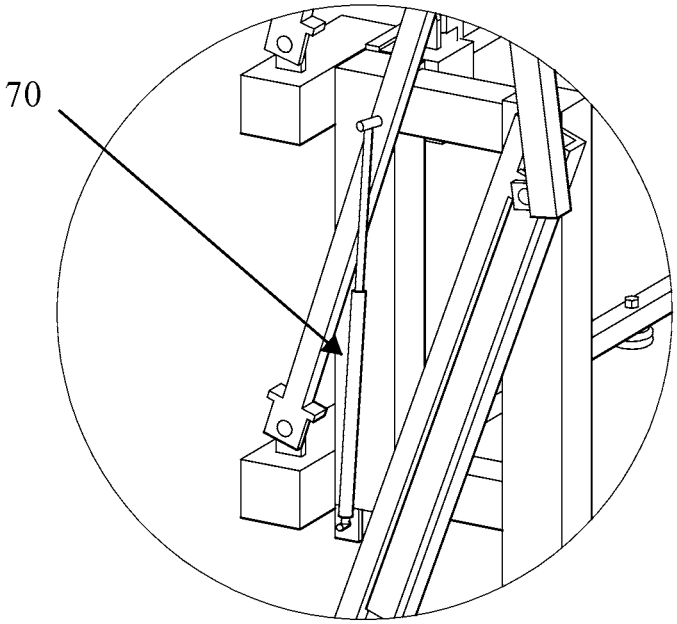
FIG. 6 is an up-close view of the hinge of the exterior gate assembly taken from FIG. 3.

Referring to FIG. 4 and FIG. 6, each of the exterior gate assembly 12 first and second side frames 30, 32 further utilizes a compression gas spring 70 for providing a smooth, slow transition between the downward, closed position and the upward, open position and for supporting each side frame 30, 32 in the upward, open position.

Figure 7:
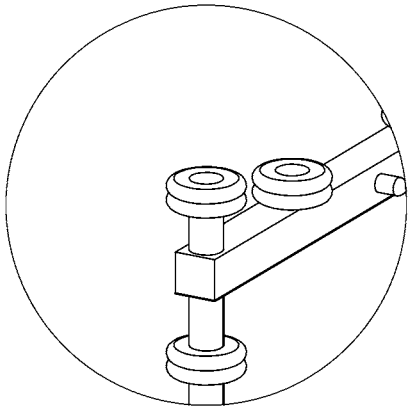
FIG. 7 is an up-close view of the multidirectional rollers as shown in FIG. 3.
Figure 8:
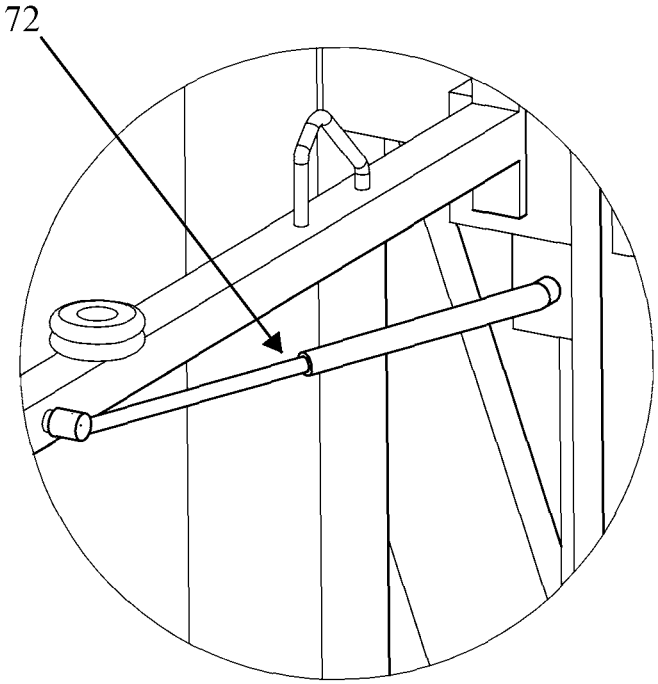
FIG. 8 is an up-close view of the compression gas spring of the interior gate assembly taken from FIG. 3.

Referring to FIG. 3 and FIG. 7, each of the interior gate assembly 14 first and second side frames 50, 52 further utilizes a compression gas spring 72 for providing a smooth, slow transition between the downward position and the upward position.

Referring to FIG. 2, each of the interior gate assembly 14 first and second side frames 50, 52 further utilizes one or more hydraulic self-closing hinges 74 for providing a smooth, slow transition between the aft, open position to the forward, closed position.

Figure 10:
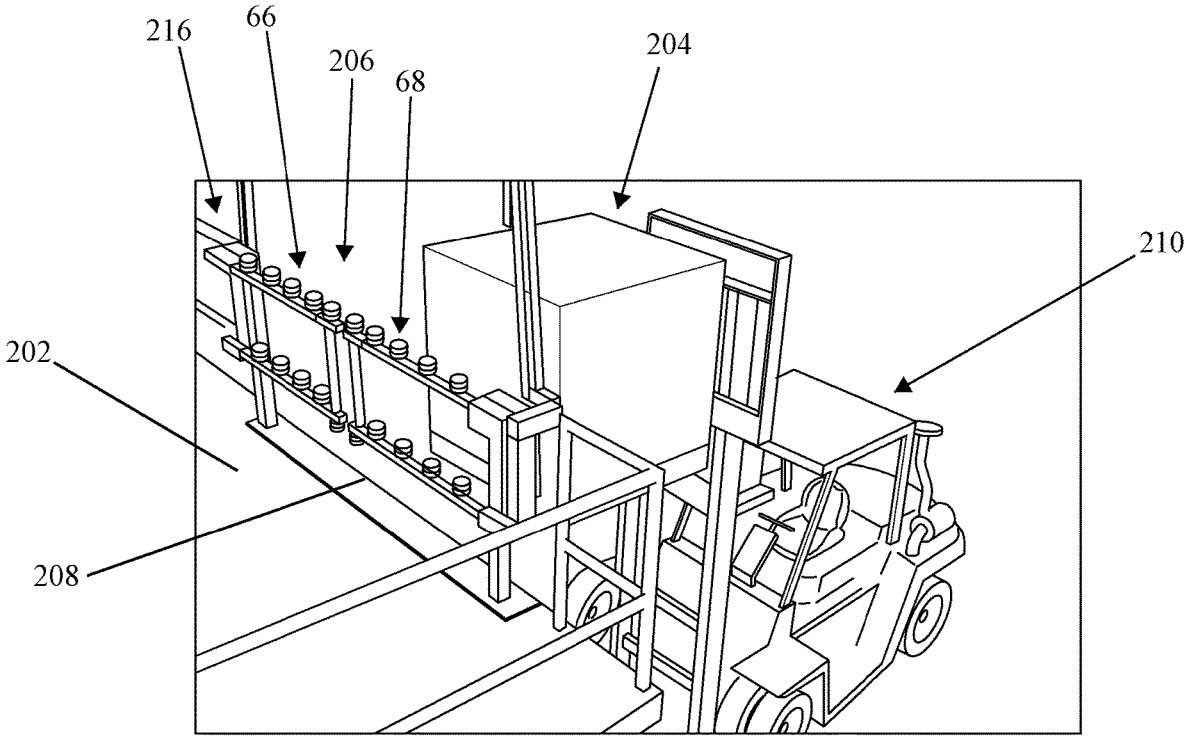
FIG. 10 is an illustrative view of a forklift approaching the mezzanine gate assembly with a load, the exterior shown while in the elevated, open position.

Generally, the operation of the gate provides independent paths of motion for each of the interior and the exterior gate assemblies 12, 14. Referring to FIG. 1 and FIG. 9-FIG. 16, initially the mezzanine gate assembly 10 is positioned in the default, closed position ready to receive the load 204 from the forklift 210 (FIG. 10). The default position provides the interior gate 14 in the forward, closed position and the exterior gate 12 is in the elevated, open position.

Figure 11:
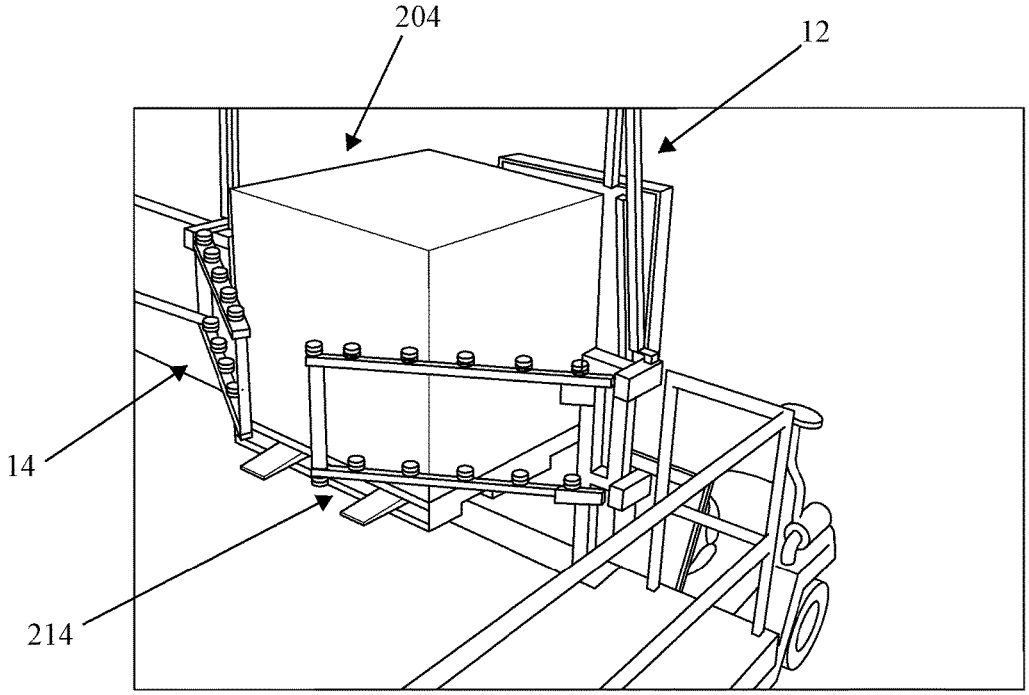
FIG. 11 is an illustrative view of the forklift engaging the interior gate assembly shown while in the forward, closed position moving towards the angled, aft position.
Figure 12:
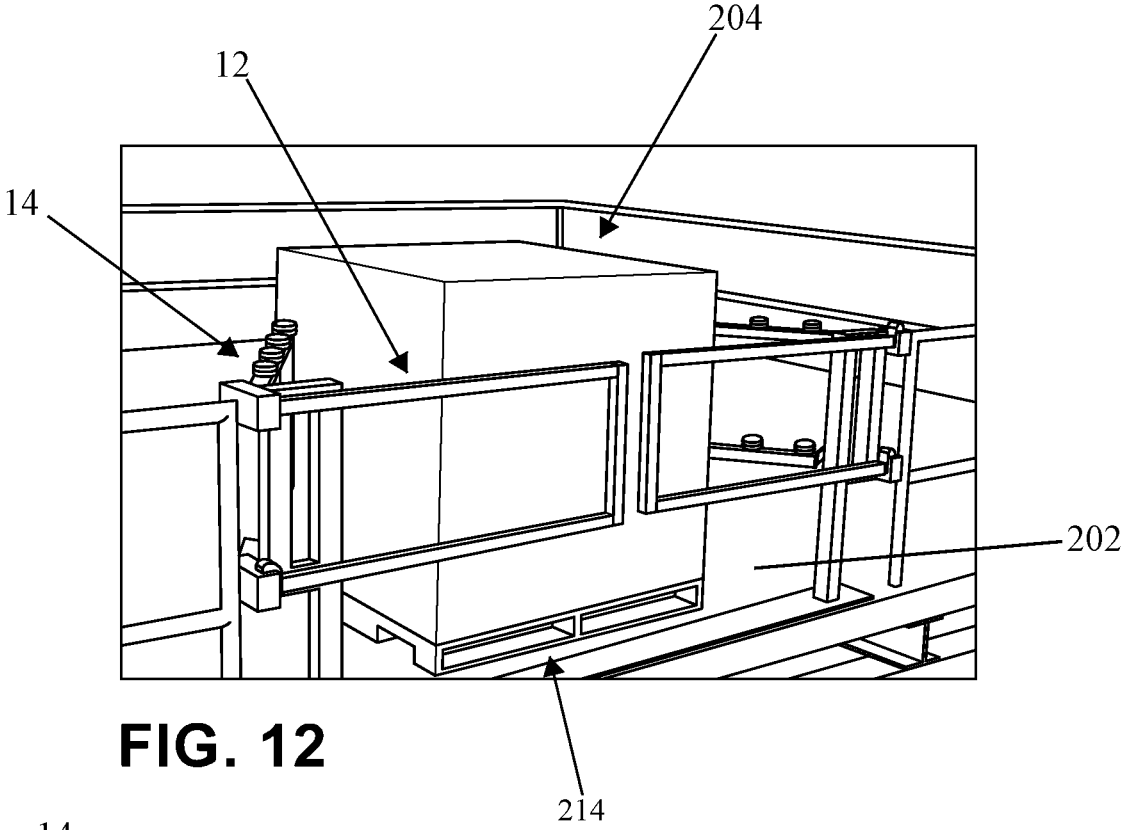
FIG. 12 is an illustrative view of the delivered load to the elevated platform showing the interior gate while in the angled, aft position and the exterior gate while in the downward, closed position.

Referring to FIG. 11, the load 204 is moved forward towards and biases the interior gate assembly 14 to open rearward in order to deliver the pallet and load 204 to the elevated platform 202—the plurality of rollers 66, 68 providing a smooth transition thereof. Thereafter, with reference to FIG. 12, the forklift 210 is released from the pallet 214 and the load 204 is position on the elevated platform 202 biasing the interior gate 14 in the angled, aft position, thereby securing the delivery opening 206 between the load 204 lateral sides and the existing railing 216 structure. Thereafter, the exterior gate assembly 12 is lowered to the downward, closed position behind the delivered goods 204 as shown.

Figure 13:
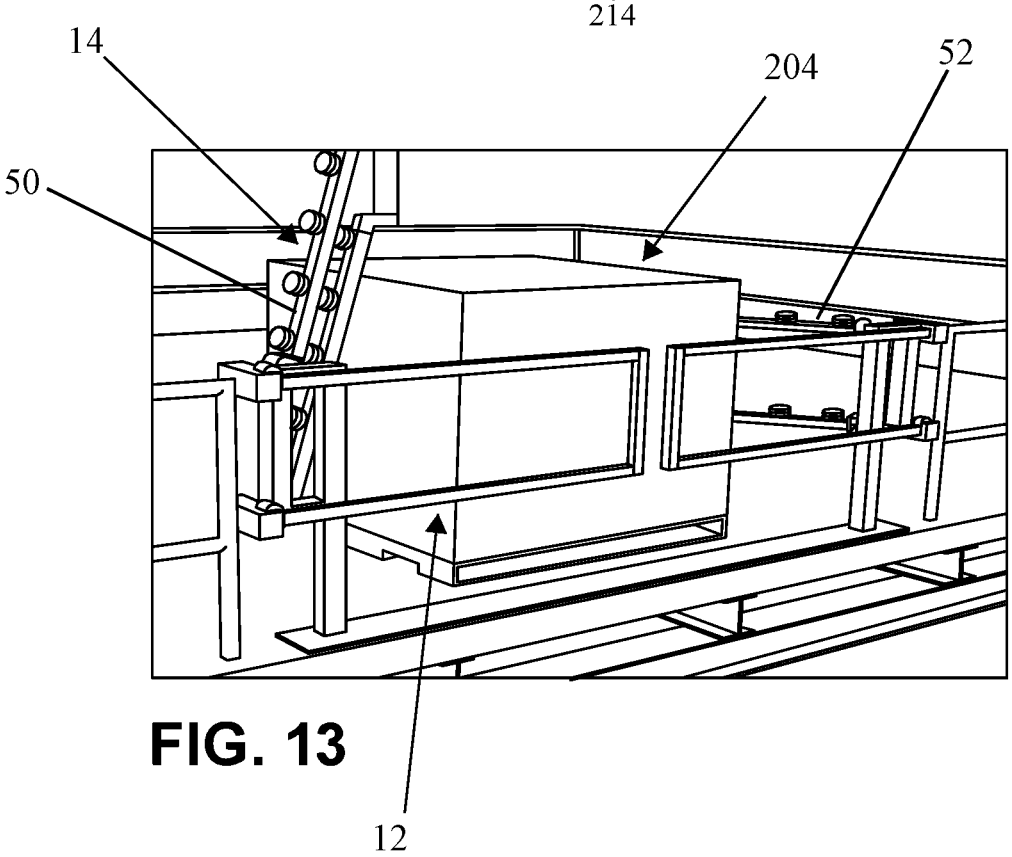
FIG. 13 is an illustrative view of the delivered load on the elevated platform showing the first side interior gate while in the forward, elevated position, the second side interior gate while in the aft, angled position, and the exterior gate assembly while in the downward, closed position.
Figure 14:
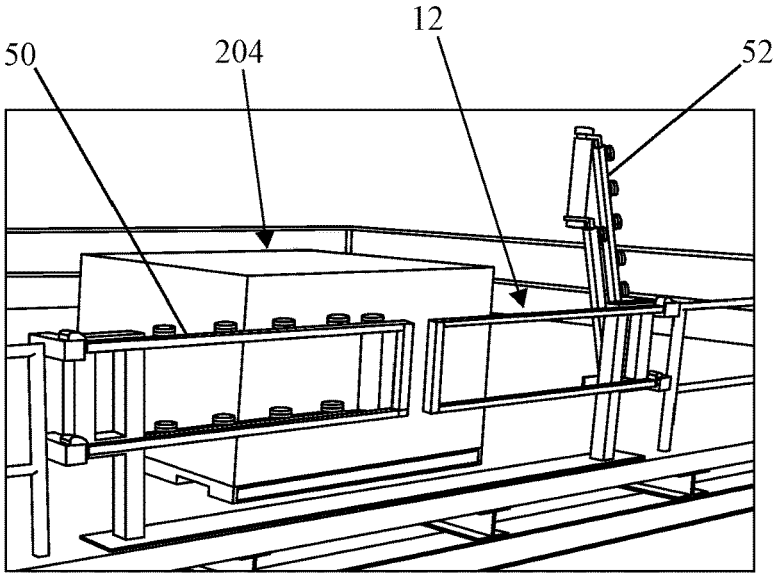
FIG. 14 is an illustrative view of the delivered load on the elevated platform showing the first side interior gate while in the forward, closed position, the second side interior gate while in the forward, elevated position, and the exterior gate assembly while in the downward, closed position.
Figure 15:
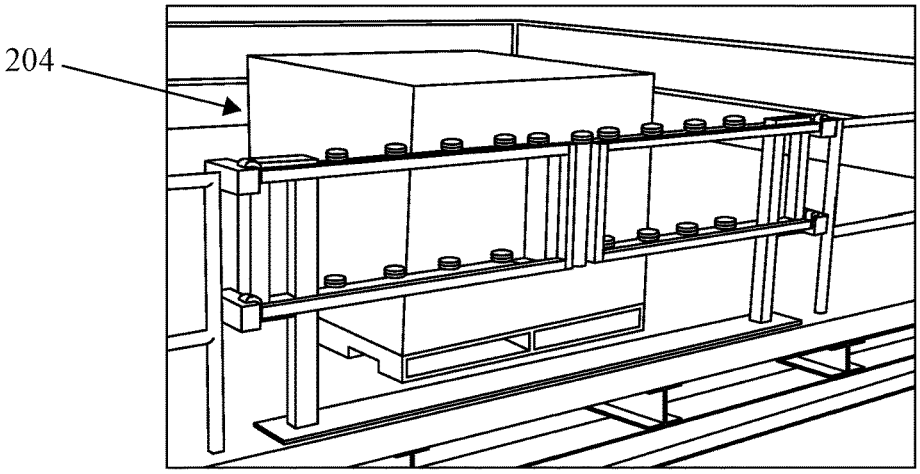
FIG. 15 is an illustrative view of the delivered load on the elevated platform showing the interior gate assembly while in the forward, closed position and the exterior gate assembly while in the downward, closed position.
Figure 16:
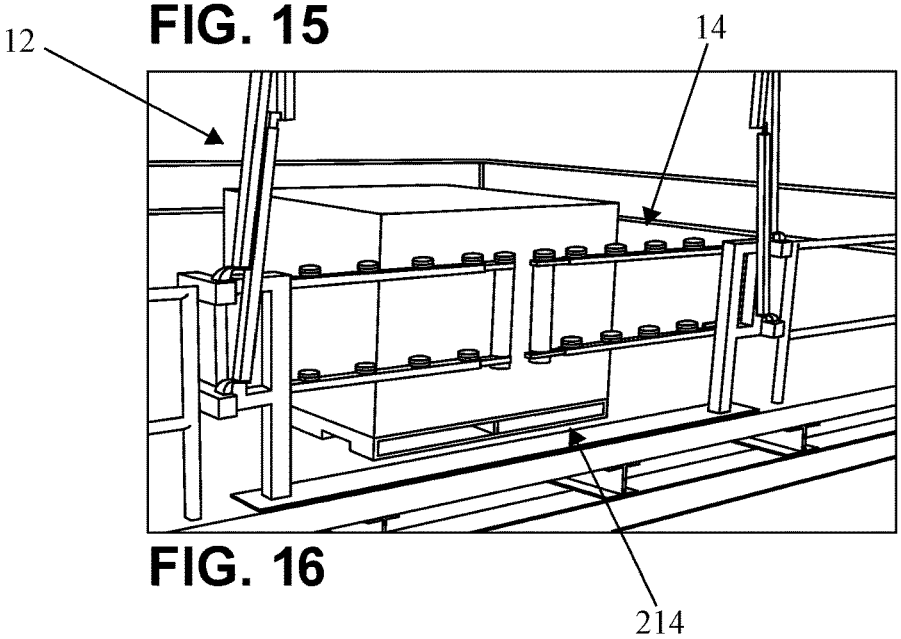
FIG. 16 is an illustrative view of the delivered load on the elevated platform showing the interior gate assembly while in the forward, closed position and the exterior gate assembly while in the elevated, open position.

Referring to FIG. 13-FIG. 15, the interior gate assembly 14 is transitioned from the angled, aft position to the forward, closed position. Each of the interior first side frame and the second side frame 50, 52 are uniquely independently moved from the angled, aft position to an elevated angled, aft position about the X and Y axis of rotation either independently or simultaneously. Thereafter, each side frame 50, 52 is moved from the elevated angled aft position to the forward elevated position about the Y axis. Finally, each side frame 50, 52 is moved downward towards the default forward, closed position. Thereafter, the exterior gate 12 assembly is moved back to the default elevated, open position. Essentially, the interior gate assembly 14 is moved upward, forward, and positioned in front of the load 204. At this point, the delivery opening 206 is completely secured with the interior gate 14 providing a continuous barrier between the respective railing 216 structure. Thus, as illustrated in FIG. 15, the load 204 can be manually removed from the pallet 214. Finally, the forklift 210 can remove the pallet 214 without moving the mezzanine gate assembly 10.

The safety gate 10 can be made in any manner and of any material chosen with sound engineering judgment. Preferably, materials will be strong, lightweight, long lasting, economic, and ergonomic.

The invention does not require that all the advantageous features and all the advantages need to be incorporated into every version of the invention.

Although preferred embodiments of the invention have been described in considerable detail, other versions and embodiments of the invention are certainly possible. Therefore, the pre-sent invention should not be limited to the described embodiments herein.

All features disclosed in this specification including any claims, abstract, and drawings may be replaced by alternative features serving the same, equivalent or similar purpose unless expressly stated otherwise.

What is claimed is:

1. A mezzanine gate assembly for positioning along an edge of an elevated platform having a railing, the mezzanine gate assembly comprising:

a first and second upright support assemblies, the first and second upright support assemblies are laterally disposed defining a delivery opening therebetween;

an exterior gate assembly operably positioned and supported within the delivery opening, the exterior gate assembly comprising:

an exterior first side frame and a reciprocal exterior second side frame, each of the exterior first side frame and exterior second side frame is independently movable between a downward, closed position to an elevated, open position; and an interior gate assembly operably positioned and supported within the delivery opening, the interior gate assembly comprising:

an interior first side frame and a reciprocal interior second side frame pivotally mounted to the first and second upright support assemblies, respectively, each of the interior first side frame and the interior second side frame is vertically movable between a downward position to an elevated position and movable about a vertical axis from a forward position to an aft position allowing travel between a forward, closed position to an aft, open position.

2. A mezzanine gate assembly positioned along an edge of an elevated platform having a railing, the mezzanine gate assembly comprising:

a first and second upright support assemblies, the first and second upright support assemblies are laterally disposed defining a delivery opening therebetween;

an exterior gate assembly operably positioned and supported within the delivery opening, the exterior gate assembly comprising:

an exterior first side frame and a reciprocal exterior second side frame, each of the exterior first side frame and the exterior second side frame is independently movable between a downward, closed position to an elevated, open position, each of the exterior first side frame and the exterior second side frame comprising:

parallel lower and upper swing arms having a proximal end and a distal end, each proximal end pivotally attached to the first respective upright support assembly, and a member pivotally connecting each of the distal ends of each swing arm; and an interior gate assembly operably positioned and supported within the delivery opening parallel and aft of the exterior gate assembly, the interior gate assembly comprising:

an interior first side frame and a reciprocal interior second side frame pivotally mounted to the first and second upright support assemblies, respectively, each side frame is vertically movable between a downward, position to an elevated position and movable about a vertical axis from a forward position to an aft position allowing travel between a forward, closed position to an aft, open position, each interior side frame comprising:

parallel lower and upper swing arms having a proximal end and a distal end, each proximal end pivotally attached to the respective upright support assembly, each of the swing arms operably providing support for a plurality of rollers; and a member pivotally connecting between each of the distal ends of each swing arm, the pivotal member operably providing support for a plurality of rollers.

3. A mezzanine gate assembly positioned along an edge of an elevated platform having a railing, the mezzanine gate assembly comprising:

a first and second upright support assemblies, each having a base portion and an upper portion, the first and second upright support assemblies are laterally disposed defining a delivery opening therebetween;

an exterior gate assembly operably positioned and supported within the delivery opening, the exterior gate assembly comprising:

an exterior first side frame and a reciprocal exterior second side frame, each of the exterior first side frame and the exterior second side frame independently providing a path of motion moving between a downward, closed position to an elevated, open position, each of the exterior first side frame and the exterior second side frame comprising:

parallel lower and upper swing arms having a proximal end and a distal end, each proximal end pivotally attached to the respective upright support assembly, and a vertical member pivotally connecting each of the distal ends of each swing arm, the vertical member remains vertical throughout the path of motion between the downward, closed position to the elevated, open position;

an interior gate assembly operably positioned and supported within the delivery opening parallel and aft of the exterior gate assembly, the interior gate assembly comprising:

an interior first side frame and a reciprocal interior second side frame pivotally mounted to the first and second upright support assemblies, respectively, each side frame being pivotal between a plurality of points of travel throughout a path of motion comprising a forward, closed position, an angled aft position, an elevated, angled aft position, a forward elevated position, each interior side frame comprising:

parallel lower and upper swing arms having a proximal end and a distal end, each proximal end pivotally attached to the respective upright support assembly, each of the swing arms operably providing support for a plurality of rollers; and a pivotal vertical member pivotally connecting between each of the distal ends of each swing arm, the vertical member remains substantially vertical throughout the path of motion of the interior side frame, the vertical member operably providing support for a plurality of rollers.

4. The mezzanine gate assembly of claim 1, wherein each of the interior first side frame and the interior second side frame comprises parallel lower and upper swing arms having a proximal end and a distal end, each proximal end is pivotally attached to the respective upright support assembly.

5. The mezzanine gate assembly of claim 4, wherein each of the interior first side frame and interior second side frame further comprises a member pivotally connecting between each of the distal ends of each swing arm, the member remains substantially vertical throughout movement of the respective interior side frame.

6. The mezzanine gate assembly of claim 5, wherein the interior first side frame and the interior second side frame support a plurality of rollers.

7. The mezzanine gate assembly of claim 6, wherein each of the exterior first side gate and the exterior second side gate comprise parallel lower and upper swing arms having a proximal end and a distal end, each of the lower and upper swing arm proximal ends pivotally attached to the respective upright support assembly, and a vertical member pivotally connecting between each of the distal ends of each swing arm, the vertical member remains substantially vertical throughout movement between the downward, closed position to the elevated, open position.

* * * * *